US006648098B2

(12) United States Patent
Nichols

(10) Patent No.: US 6,648,098 B2
(45) Date of Patent: Nov. 18, 2003

(54) SPIRAL ACOUSTIC WAVEGUIDE ELECTROACOUSTICAL TRANSDUCING SYSTEM

(75) Inventor: George Nichols, Dover, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 10/085,382

(22) Filed: Feb. 28, 2002

(65) Prior Publication Data

US 2003/0150668 A1 Aug. 14, 2003

Related U.S. Application Data

(63) Continuation-in-part of application No. 10/072,784, filed on Feb. 8, 2002.

(51) Int. Cl.[7] ..... H04R 1/28; H04R 1/02

(52) U.S. Cl. ..... 181/193; 181/182; 381/336

(58) Field of Search ..... 181/193, 182, 181/198, 185, 199; 381/334, 336, 337, 338, 339, 353

(56) References Cited

U.S. PATENT DOCUMENTS 1,888,769 A * 11/1932 Muench ..... 181/193
1,890,719 A * 12/1932 Busch ..... 181/193
3,687,221 A * 8/1972 Bonnard ..... 181/191
4,628,528 A 12/1986 Bose et al.
5,751,827 A * 5/1998 Takahashi ..... 381/340
5,975,236 A * 11/1999 Yamamoto et al. ..... 181/156
6,104,823 A * 8/2000 Tanaka ..... 381/345
6,278,789 B1 * 8/2001 Potter ..... 381/338
6,356,643 B2 * 3/2002 Yamagishi et al. ..... 381/349

* cited by examiner

*Primary Examiner*—Robert E. Nappi
*Assistant Examiner*—Eduardo Colon-Santana
(74) *Attorney, Agent, or Firm*—Fish & Richardson P.C.

(57) ABSTRACT

The invention features an acoustic waveguide and system for transmitting pressure wave energy produced by an electroacoustical transducer in a medium that propagates pressure wave energy. The acoustic waveguide and system includes a tube defining a spiral-shaped channel with a length of L. The tube has a first end and a second end with the first end closed and the second end open to the medium. The tube has a transducer opening for accommodating an electroacoustical transducer located between the first and second end of the tube. The system includes an electroacoustical transducer mounted to the acoustic waveguide.

22 Claims, 4 Drawing Sheets

SPIRAL ACOUSTIC WAVEGUIDE ELECTROACOUSTICAL TRANSDUCING SYSTEM

This is a continuation-in-part of application Ser. No. 10/072,784 filed Feb. 8, 2002.

TECHNICAL FIELD

This invention relates to acoustic waveguide electroacoustical transducing systems.

BACKGROUND OF THE INVENTION

For background, reference is made to Bose U.S. Pat. No. 4,628,528 and Bose U.S. Pat. No. 6,278,789 B1, both of which are incorporated by reference herein.

It is an important object of the invention to provide an improved acoustic waveguide and electroacoustical transducing system which has a long waveguide channel within a relatively compact structure.

SUMMARY OF THE INVENTION

In an aspect, the invention features an acoustic waveguide for transmitting pressure wave energy produced by an electroacoustical transducer in a medium that propagates pressure wave energy. The acoustic waveguide has a tube defining a spiral-shaped channel with a length of L. The tube has a first end and a second end with a transducer opening for accommodating an electroacoustical transducer located adjacent to the first end of the tube. The second end of the tube is open the medium.

Embodiments may include one or more of the following features. The spiral-shaped channel may have a smoothly changing curvature with radius. Additionally, the inner walls of the waveguide may be contiguous. The effective length of channel L may be approximately one quarter of the wavelength of the lowest frequency pressure wave energy to be transmitted by the waveguide. The lowest frequency to be transmitted corresponds substantially to the frequency below which the output level commences falling substantially continuously with frequency. The tube may define a spiral shaped channel that has a rectangular cross section. The tube may define a spiral shaped channel that has a rectangular cross section. The tube may define a spiral shaped channel that is coiled in a single plane, forming a flat spiral, or coiled in a plurality of planes, forming a helical spiral.

In another aspect of the invention, an acoustic waveguide for transmitting pressure wave energy produced by an electroacoustical transducer in a medium that propagates pressure wave energy, the waveguide has a tube having a first end and a second end and formed in a spiral configuration. The first end of the tube is closed and the second end of the tube is open to the medium and a transducer opening for accommodating an electroacoustical transducer is located on the tube between the first end and second end of the tube. The tube defines a first spiral-shaped channel located between the transducer opening of the tube and the first end of the tube and a contiguous second spiral-shaped channel located between the transducer opening of the tube and the second end of the tube.

Embodiments may include one or more of the following features. The first spiral-shaped channel defined by the tube may have a length of ⅓L while the second spiral-shaped channel may have a length of ⅔L. The length of the first spiral-shaped channel, ⅓L, plus the length of the second spiral-shaped channel, ⅔L, plus end effect may be approximately equal one quarter of the wavelength of the lowest frequency pressure wave energy to be transmitted by the waveguide. The first and second spiral-shaped channels may each have a smoothly changing curvature with radius. The inner walls of the tube may be contiguous. The first spiral-shaped channel may have substantially the same cross-section as the second spiral-shaped channel. The cross section of the first and second spiral-shaped channels may be rectangular. The tube may be composed of PVC. The tube defining the spiral-shaped channel may be coiled in a single plane, forming a flat spiral. The tube may be coiled in a plurality of planes, forming a helical spiral. A transducer housing may be attached to the tube and the tube may have a second transducer opening located between the tube and the transducer housing. The tube may be of two-piece construction which may be assembled with screws, bolts, clips, adhesive, glue and the like.

In another aspect of the invention, a system for transmitting pressure wave energy in a medium that propagates pressure wave energy in a medium, the system includes an electroacoustical transducer having a vibratile surface and a spiral waveguide.

Embodiments of the invention may have one or more of the following advantages.

A spiral waveguide permits a long waveguide channel within a relatively compact structure. A long waveguide channel improves the bass response of a loudspeaker system, while a compact structure can be particularly convenient in a loudspeaker system where physical space is limited, such as in an automobile or portable stereo. Additionally, a spiral waveguide does not have any abrupt 90 or 180 degree bends in the channel, which minimizes unwanted turbulence in the waveguide channel. A spiral waveguide can also be configured to have an open and a closed end with a transducer positioned at a specific distance between the open and closed end in order to reduce the first peak in frequency response of the acoustic energy transmitted by the waveguide.

Other features, objects and advantages will become apparent from the following detailed description when read in connection with the accompanying drawing in which:

BRIEF DESCRIPTION OF THE SEVERAL VIEWS OF THE DRAWING

Like reference symbols in the various drawings indicate like elements.

DETAILED DESCRIPTION

Figure 1A:
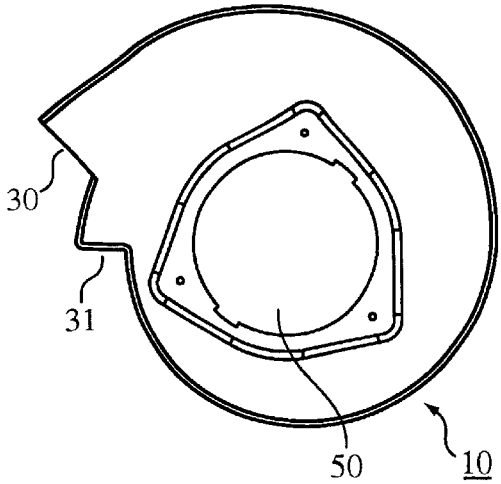
FIG. 1A is a top view of a top spiral acoustic waveguide member comprising an electroacoustical transducing system having an open end and a closed end.
Figure 1B:
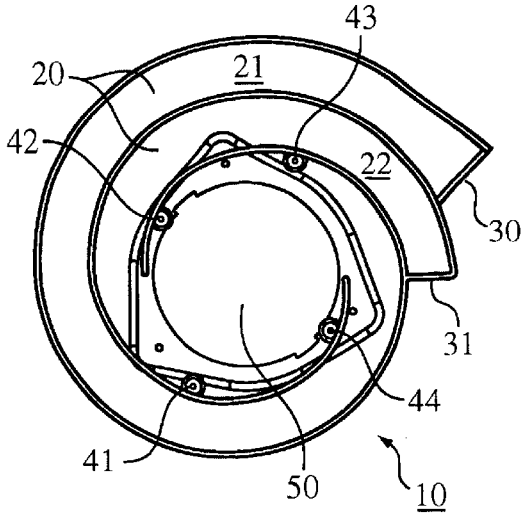
FIG. 1B is a bottom view of the top spiral waveguide member of FIG. 1A.
Figure 1C:
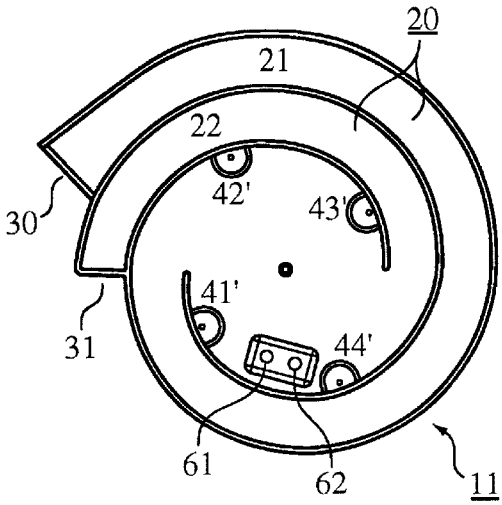
FIG. 1C is a top view of a bottom spiral waveguide member having an open end and a closed end.
Figure 1D:
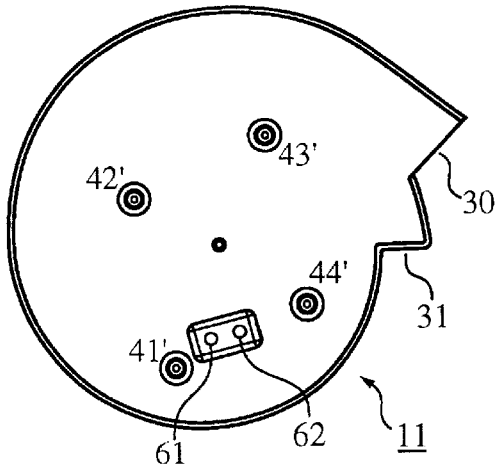
FIG. 1D is a bottom view of the bottom spiral waveguide member of FIG. 1C.

With reference now to the drawings, FIGS. 1A and 1B show the top and bottom view, respectively, of a top waveguide member 10, while FIGS. 1C and 1D show the top and bottom view, respectively, of a matching bottom waveguide member 11. A spiral waveguide is formed by attaching a top waveguide member 10 with a bottom waveguide member 11, thus forming a waveguide channel 20 (with a length L) having an open end 30 and a closed end 31. In this particular embodiment, the two waveguide members, 10 and 11, are attached by four screws through the four holes, 41, 42, 43 and 44. However, the two waveguide members may be attached by screws, bolts, nails, clips, tabs and slots, tongues and grooves, pins, glue, adhesive, cement and the like.

Referring again to FIGS. 1A and 1B, the top waveguide member 10 has a transducer opening 50, where an electroacoustical transducer such as a loudspeaker transducer (not shown) may be mounted. In this particular embodiment, the bottom waveguide member 11 provides for two holes 61, 62 which provide a passage for wire connecting the transducer to an electrical signal source. The transducer opening 50 is located along the waveguide channel 20 such that it divides the waveguide channel 20 into two contiguous channels, an open-ended channel 21 (having a length $L_1$) and a closed-ended channel 22 (having a length $L_2$). Both of the contiguous channels 21, 22 have a smoothly changing curvature with radius, substantially identical rectangular cross sections, and are centered about the same spiral axis.

The length of waveguide channel 20 plus any end effect is approximately one quarter of the wavelength of the lowest frequency pressure wave energy to be transmitted by the waveguide. For example, if the lowest frequency pressure wave energy to be transmitted by the waveguide is 60 Hz in air at room temperature, the length of the waveguide channel 20 (plus any end effect) is approximately 1.4 meters.

The walls of the waveguide channel 20 are hard. PVC, ABS, Lexan, other hard plastic, metal, or wood materials or the like provide suitable material to construct the walls of the waveguide.

The transducer may be mounted at any location along the waveguide channel 20 depending on the design of the system. In the embodiment illustrated in FIGS. 1A–1D, the transducer opening 50 is configured to mount an electroacoustical transducer such that path length of the open-ended channel 21 is approximately twice as long as the closed-ended channel 22. This positioning of the transducer is useful for greatly reducing the first resonance peak that would be present in the frequency response of the acoustic energy transmitted by a single-ended waveguide.

Figure 2A:
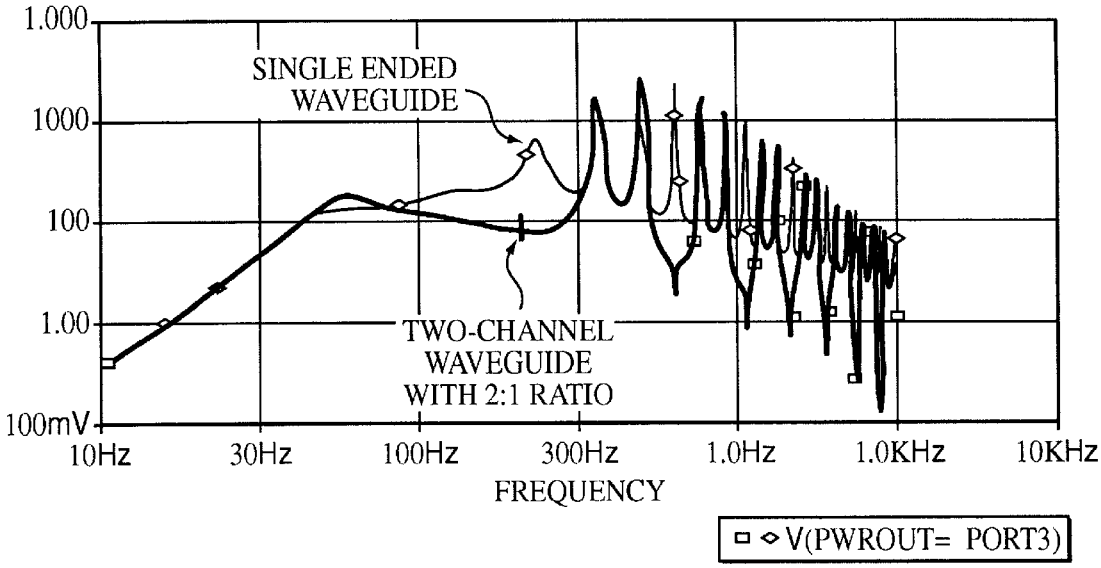
FIG. 2A is a graphical representation of acoustic power output as a function of frequency (i) at the end of a single-ended waveguide and (ii) at the end of the open-ended channel of a two channel waveguide having a 2:1 channel length ratio.
Figure 2B:
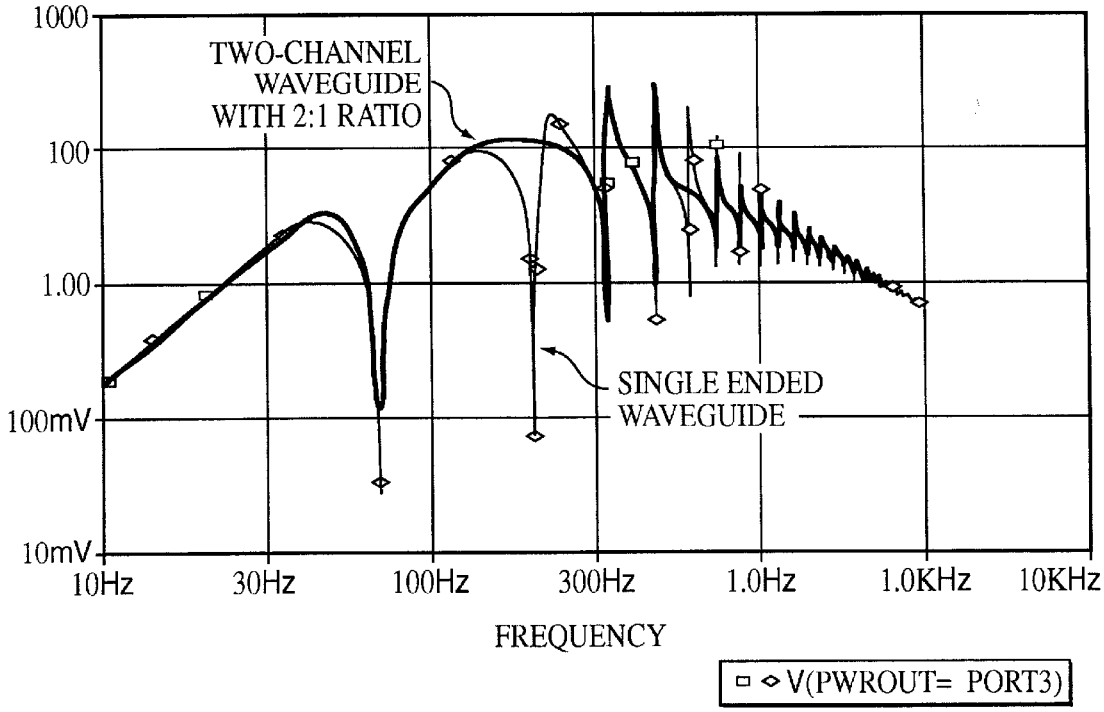
FIG. 2B is a graphical representation of the acoustic power output as a function of the frequency at the transducer of (i) a single-ended waveguide and a two-channel waveguide having a 2:1 channel length ratio.

FIGS. 2A and 2B show a graphical representation of the acoustic power output as a function of frequency at the open end of a waveguide channel (FIG. 2A) and at the transducer opening (FIG. 2B) (i) with the transducer located adjacent to the closed end of the waveguide channel of length L and (ii) with the transducer located between the open end and the closed end such that the distance between the open end and the transducer is approximately twice as long (⅔L) as the distance between the closed end and the transducer (⅓L). In this particular illustration, the waveguide channel is approximately 1.34 meters in length, has a circular cross section with a cross-sectional diameter of 7.23 cm, and is approximately 56% of the cross-sectional area of the transducer. In this example, a volume located behind the transducer and between the transducer and waveguide channel and is approximately 500 cubic centimeters. A volume located behind the transducer and between the transducer and waveguide channel is not necessary and is preferably as small as practical (ideally zero) if the mechanical dimensions of the transducer, the cross-sectional area of the waveguide and other design restrictions permit it. Removing or reducing the volume between the transducer and waveguide channel in this example would still leave the beneficial results described of a reduction in the first resonance peak.

As shown in FIG. 2A, the first resonance peak, which occurs at approximately 200 Hz in this example, is greatly reduced by positioning the transducer at a location that divides the waveguide channel into a closed end channel of length ⅓L and an open ended channel of length ⅔L (i.e., a 2:1 ratio). Similarly, FIG. 2B shows that the transducer output does not experience a corresponding null (i.e, reduced displacement) at approximately 200 Hz.

Figure 3A:
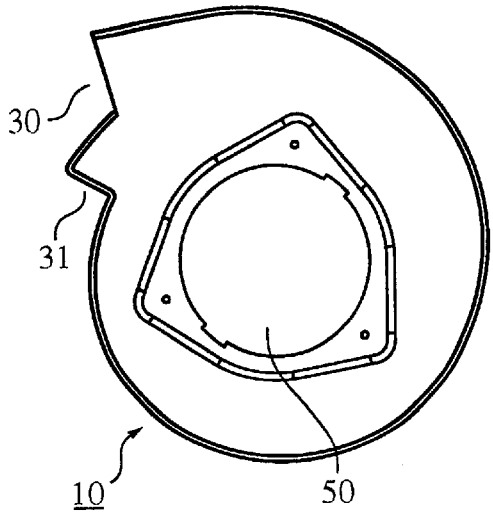
FIG. 3A is a top view of a top spiral waveguide member having an open end and a closed end and having a transducer housing.
Figure 3B:
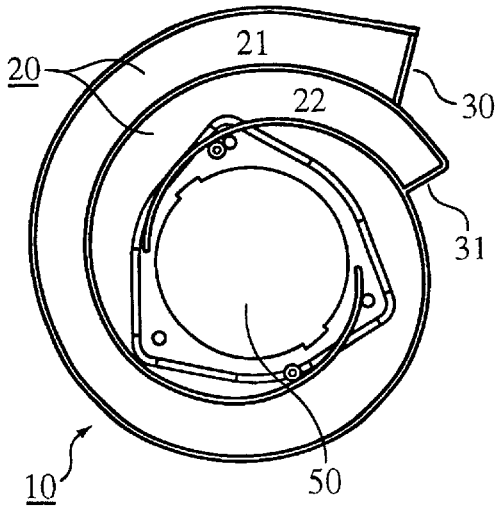
FIG. 3B is a bottom view of the top spiral waveguide member of FIG. 3A.
Figure 3C:
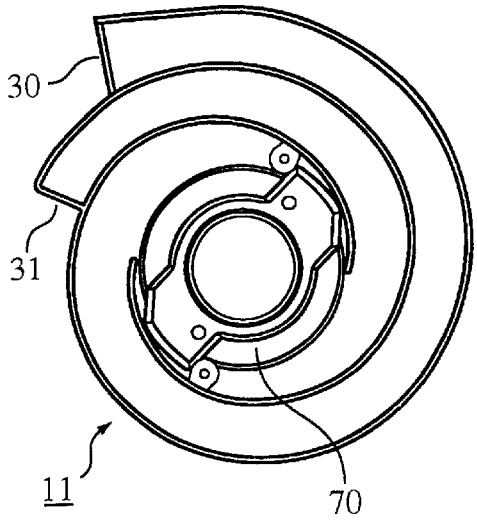
FIG. 3C is a top view of a bottom spiral waveguide member having an open end and a closed end and having a transducer housing.
Figure 3D:
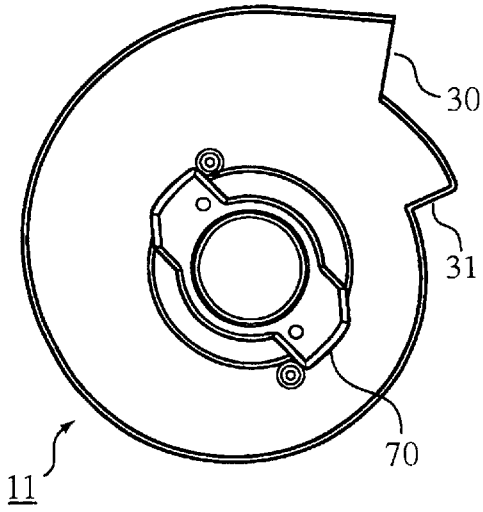
FIG. 3D is a bottom view of the bottom spiral waveguide member of FIG. 3C.
Figure 3E:
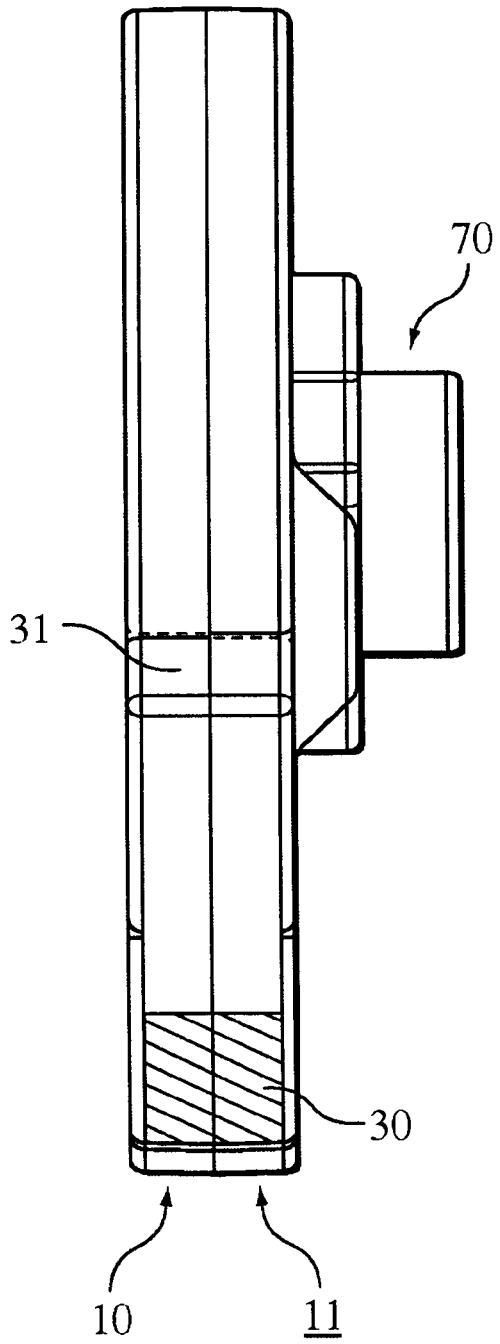
FIG. 3E is a side view of the top spiral waveguide member shown in FIGS. 3A–B attached to the bottom waveguide member shown in FIGS. 3C–D.

FIGS. 3A–3E show another embodiment of a spiral waveguide electroacoustical transducing system. FIGS. 3A and 3B show the top and bottom view, respectively, of a top waveguide member 10, while FIGS. 3C and 3D show the top and bottom view, respectively, of a matching bottom waveguide member 11. FIG. 3E shows a side view of the assembled spiral waveguide electroacoustical transducing system.

The waveguide shown in FIGS. 3A–3E is similar in structure to the waveguide shown in FIGS. 1A–1D, having a spiral-shaped waveguide channel 20 with an open end 30 and closed end 31. A transducer opening 50 is provided in the top waveguide member 10 and divides the waveguide channel 20 into an open-ended channel 21 and a contiguous closed-ended channel 22. The transducer opening is located along the waveguide channel 20 such that the open-ended channel 21 is approximately twice as long as the closed-ended channel 22. In this embodiment, the dimension between the top and bottom surfaces of the assembled waveguide is reduced to make a more compact structure by allowing the rear of the transducer to protrude beyond said bottom surface. Said rear of the transducer is covered by back housing 70 which may be formed as an integral part of the bottom waveguide member 11 or it may be formed as a separate structure to be affixed to the rear of the bottom waveguide member 11. The front side of the transducer faces out of the transducer opening 50. In the embodiment shown in FIGS. 3A–3E, a volume located behind the transducer and between the transducer and waveguide is created. While from an acoustical performance standpoint, it is normally preferable to have a minimal volume behind the transducer and between the transducer and waveguide, other design considerations such as limitations in the amount of physical space available for the waveguide may necessitate a volume behind the transducer and between the transducer and the waveguide.

A number of embodiments of the invention have been described. Nevertheless, it will be understood that various modifications may be made without departing from the spirit and scope of the invention. For example, the embodiments shown in FIGS. 1A–D and 3A–E illustrate a spiral waveguide assembly having two contiguous spiral channels, 21, 22, which radiate out from the transducer opening 50. However, another embodiment of the spiral waveguide may have a single spiral channel radiating out from an inner end to an outer end, with the electroacoustical transducer mounted adjacent to the inner end (thus forming a single-ended waveguide). The transducer may be mounted such that the vibratile surface of the transducer is parallel to the plane of the spiral waveguide channels as shown in FIGS. 1A–D and 3A–E, or it may be mounted such that the vibratile surface is at the end of a channel, perpendicular to the plane of the spiral waveguide channels. The spiral waveguide may also be formed as a flat spiral (as illustrated in FIGS. 1A–D and 3A–E) where the waveguide channel is coiled in a single plane, or the waveguide may be formed as a helical spiral (i.e., a helix) where the waveguide channel is coiled in a constantly changing plane. The cross section of the waveguide channel may be rectangular, circular, oval or the like. The length and cross section of the waveguide channels may be modified according to the lowest desired frequency of transmission, medium of transmission, and surface area of the vibratile surface of the transducer. The transducer does not have to be partially or fully enclosed by the waveguide structure with the front of said transducer facing out of the waveguide through hole 50, but may, for example, be mounted external to said waveguide structure such that the front of the transducer faces into the waveguide through hole 50. The spiral acoustic waveguide as shown in FIGS. 1A–D and 3A–E show a two-piece construction of the waveguide channel, however, the two piece construction may consist of a single top or bottom member comprising the waveguide walls and a corresponding bottom or top member which is substantially flat and which, when assembled with the top or bottom member, forms the fourth wall of the waveguide or construction of the waveguide channel may be of a single piece of construction or may be formed from multiple pieces attached together. Additional embodiments may include damping material, such as polyester, disposed within one or more of the waveguide channels.

It is evident that those skilled in the art may make numerous modifications of the departures from the specific apparatus and techniques disclosed herein without departing from the inventive concepts. Consequently, the invention is to be construed as embracing each and every novel feature and novel combination of features present in or possessed by the apparatus and techniques disclosed herein and limited solely by the spirit and scope of the appended claims.

What is claimed is:

1. An acoustic waveguide for transmitting pressure wave energy produced by an electroacoustical transducer in a medium that propagates pressure wave energy, the waveguide comprising:

a tube having a first end and a second end and formed in a spiral configuration, the tube having a transducer opening for accommodating an electroacoustical transducer between the first end and second end of the tube;

wherein the tube defines a first spiral-shaped channel located between the transducer opening of the tube and the first end of the tube and a contiguous second spiral-shaped channel located between the transducer opening of the tube and the second end of the tube; and wherein the first end of the tube is closed and the second end of the tube is open to the medium.

2. The acoustic waveguide of claim 1, wherein the first spiral-shaped channel defined by the tube has a length of ⅓L and the second spiral-shaped channel has a length of ⅔L.

3. The acoustic waveguide of claim 1 wherein the first spiral-shaped channel and second spiral-shaped channel each have a smoothly changing curvature with radius.

4. The acoustic waveguide of claim 1 wherein the inner walls of the tube are contiguous.

5. The acoustic waveguide of claim 1 wherein the length of the first spiral-shaped channel, ⅓L, plus the length of the second spiral-shaped channel, ⅔L, is approximately one quarter of the wavelength of the lowest frequency pressure wave energy to be transmitted by the waveguide.

6. The acoustic waveguide of claim 1, wherein the first spiral-shaped channel defined by the tube has substantially the same cross-section as the second spiral-shaped channel defined by the tube.

7. The acoustic waveguide of claim 6, wherein the cross section of the first and second spiral-shaped channels is rectangular.

8. The acoustic waveguide of claim 1 wherein the tube is composed of rigid plastic.

9. The acoustic waveguide of claim 1, wherein the tube is coiled in a single plane, forming a flat spiral.

10. The acoustic waveguide of claim 1, wherein the tube is coiled in a plurality of planes, forming a helical spiral.

11. The acoustic waveguide of claim 1, further comprising:

a transducer housing attached to the tube; and wherein the tube has a second electroacoustical transducer opening located between the tube and the transducer housing.

12. The acoustic waveguide of claim 1, wherein the tube comprises:

an upper tube member having a top surface and a bottom surface, the top surface having the transducer opening and the bottom surface having a first spiral-shaped groove defining the upper portion of the first spiral-shaped channel located between the transducer opening and the first end of the tube, the bottom surface also having a second spiral-shaped groove contiguous to the first spiral-shaped groove and defining an upper portion of the second spiral-shaped channel located between the transducer opening and the second end of the tube; and a lower tube member having a top surface and a bottom surface, the top surface having a first spiral-shaped groove defining the lower portion of the first spiral-shaped channel located between the transducer opening and the first end of the tube, the top surface also having a second spiral-shaped groove contiguous to the first spiral-shaped groove and defining a lower portion of the second spiral-shaped channel located between the transducer opening and the second end of the tube;

wherein the bottom surface of the upper tube member is attached to the top surface of the lower tube member such that the first and second grooves of each member align to form the first spiral-shaped channel and the second spiral-shaped channel.

13. The acoustic waveguide of claim 12, further comprising:

a transducer housing attached to the tube; and wherein the bottom surface of the lower tube member has a second transducer opening located between the tube and the transducer housing.

14. The acoustic waveguide of claim 12, wherein the upper tube member is attached to the lower tube member with screws.

15. The acoustic waveguide of claim 12 wherein the upper tube member is attached to the lower tube member with adhesive.

16. An acoustic waveguide in accordance with claim 1 wherein said waveguide comprises a first assembly forming three waveguide walls and a second assembly that is essentially a flat plate comprising a fourth waveguide wall closing the waveguide.

17. A system for transmitting pressure wave energy in a medium that propagates pressure wave energy in a medium, the system comprising:

an electroacoustical transducer having a vibratile surface; and a spiral waveguide comprising, a tube having a first end and a second end and coiled in a spiral configuration, the tube having a transducer opening acoustically coupled to the electroacoustical transducer between the first and second end of the tube;

wherein the tube defines a first spiral-shaped channel located between the transducer opening of the tube and the first end of the tube and a contiguous second spiral-shaped channel located between the transducer opening of the tube and the second end of the tube; and wherein the first end of the tube is closed and the second end of the tube is open to the medium.

18. The system of claim 17, wherein the first spiral-shaped channel defined by the tube has a length of ⅓L and the second spiral-shaped channel has a length of ⅔L.

19. The system of claim 18 wherein the length of the first spiral-shaped channel, ⅓L, plus the length of the second spiral-shaped channel, ⅔L, plus end effects, is approximately equal to one quarter of the wavelength of the lowest frequency pressure wave energy to be transmitted by the waveguide.

20. The system of claim 17 wherein the inner walls of the tube are contiguous.

21. The system of claim 17, wherein the first spiral-shaped channel defined by the tube has substantially the same cross section as the second spiral-shaped channel defined by the tube.

22. The system of claim 21, wherein the cross section of the first and second spiral-shaped channels is rectangular.

* * * * *